US012722761B2

(12) United States Patent
Kato et al.

(10) Patent No.: US 12,722,761 B2
(45) Date of Patent: Sep. 1, 2026

(54) TRIM ANGLE CONTROL APPARATUS AND TRIM ANGLE CONTROL METHOD

(71) Applicant: Honda Motor Co., Ltd., Tokyo (JP)

(72) Inventors: Akira Kato, Saitama (JP); Hiroshi Yamamoto, Saitama (JP); Naoki Aikawa, Saitama (JP); Kazumi Miyashita, Saitama (JP); Akifumi Fujima, Saitama (JP); Yoshiyuki Misumi, Saitama (JP); Tokio Unno, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 402 days.

(21) Appl. No.: 18/280,523

(22) PCT Filed: Mar. 8, 2021

(86) PCT No.: PCT/JP2021/008860
§ 371 (c)(1),
(2) Date: Sep. 6, 2023

(87) PCT Pub. No.: WO2022/190156
PCT Pub. Date: Sep. 15, 2022

(65) Prior Publication Data

US 2024/0166323 A1 May 23, 2024

(51) Int. Cl.
*B63H 20/10* (2006.01)
*B63H 21/21* (2006.01)

(52) U.S. Cl.
CPC ..... *B63H 20/10* (2013.01); *B63H 21/21* (2013.01)

(58) Field of Classification Search
CPC ..... B63H 20/10; B63H 21/21; B63H 20/08
See application file for complete search history.

(56) References Cited

U.S. PATENT DOCUMENTS 9,463,858 B1 10/2016 Remmers et al.
2011/0143608 A1 6/2011 Chiecchi
2011/0294370 A1* 12/2011 Kuriyagawa ..... B63H 20/10 440/1

FOREIGN PATENT DOCUMENTS

DE 102007048058 A1 4/2009
JP 3693737 B2 * 9/2005
(Continued)

OTHER PUBLICATIONS

JP 3693737 B2 (Year: 2005).*
(Continued)

*Primary Examiner* — Roy Rhee
(74) *Attorney, Agent, or Firm* — Duft & Bornsen, PC

(57) ABSTRACT

Trim angle control apparatus configured to control a trim angle of an outboard motor including a prime mover, including: a detector configured to detect a rotational speed of the prime mover; an actuator configured to adjust the trim angle of the outboard motor; an operation member configured to be operated by a ship operator to input a change command for changing the trim angle; and an electronic control unit including a processor and memory. The memory stores a target value of the trim angle for each rotational speed range of the prime mover in advance. The processor is configured to perform: setting a target value of the trim angle based on the rotational speed; and controlling the actuator so that the trim angle becomes the target value. The setting includes changing the target value in accordance with the change command when the change command is input through the operation member.

8 Claims, 5 Drawing Sheets

(56) References Cited

FOREIGN PATENT DOCUMENTS

| | | | |
|---|---|---|---|
| JP | 2009269531 | A | 11/2009 |
| JP | 2011246063 | A | 12/2011 |
| JP | 2013256261 | A | 12/2013 |
| JP | 2018030574 | A | 3/2018 |
| JP | 2019001274 | A | 1/2019 |
| JP | 2019131178 | A | 8/2019 |

OTHER PUBLICATIONS

International Search Report; Application PCT/JP2021/008860; May 18, 2021.
German Office action; Application 112021007223.4; 13 pages; Mar. 24, 2026.

* cited by examiner

TRIM ANGLE CONTROL APPARATUS AND TRIM ANGLE CONTROL METHOD

CROSS-REFERENCE TO RELATED APPLICATION

This application is a National Stage of PCT international application Ser. No. PCT/JP2021/008860 filed on Mar. 8, 2021 which designates the United States, incorporated herein by reference.

TECHNICAL FIELD

This invention relates to a trim angle control apparatus and a trim angle control method configured to control a trim angle of an outboard motor.

BACKGROUND ART

As this type of technology, a device that controls a trim angle of an outboard motor is conventionally known (e.g., refer to Patent Literature 1). This device described in Patent Literature 1 detects the engine speed of the outboard motor, determines a target value of the trim angle based on the detected engine speed and a predetermined characteristic, and controls the trim angle to the target value.

CITATION LIST

Patent Literature

Patent Literature 1: Specification of U.S. Pat. No. 9,463,858

SUMMARY OF INVENTION

Technical Problem

The ship operator of a ship may change the trim angle in accordance with the navigation situation at that time. However, when the trim angle is adjusted simply in accordance with the engine speed as in the device described in Patent Literature 1, the trim angle is changed every time the engine speed changes, and thus it is difficult to reflect the intention of the ship operator to change the trim angle in accordance with the navigation situation.

Solution to Problem

An aspect of the present invention is a trim angle control apparatus configured to control a trim angle of an outboard motor including a prime mover, including: a detector configured to detect a rotational speed of the prime mover; an actuator configured to adjust the trim angle of the outboard motor; an operation member configured to be operated by a ship operator to input a change command for changing the trim angle; and an electronic control unit including a processor and a memory coupled to the processor. The memory stores a target value of the trim angle for each rotational speed range of the prime mover in advance. The processor is configured to perform: setting a target value of the trim angle based on the rotational speed detected by the detector; and controlling the actuator so that the trim angle becomes the target value. The setting includes changing the target value in accordance with the change command when the change command is input through the operation member.

Another aspect of the present invention is a trim angle control method configured to control a trim angle of an outboard motor including a prime mover, including: storing a target value of the trim angle for each rotational speed range of the prime mover in advance; setting a target value of the trim angle based on a rotational speed of the prime mover detected by a detector; and controlling an actuator configured to adjust the trim angle of the outboard motor so that the trim angle becomes the target value. The setting includes changing the target value in accordance with a change command for changing the trim angle when the change command is input through an operation member configured to be operated by a ship operator.

Advantageous Effects of the Invention

According to the present invention, it becomes possible to reflect the intention of the ship operator to change the trim angle in accordance with the navigation situation.

DESCRIPTION OF EMBODIMENT

Figure 1:
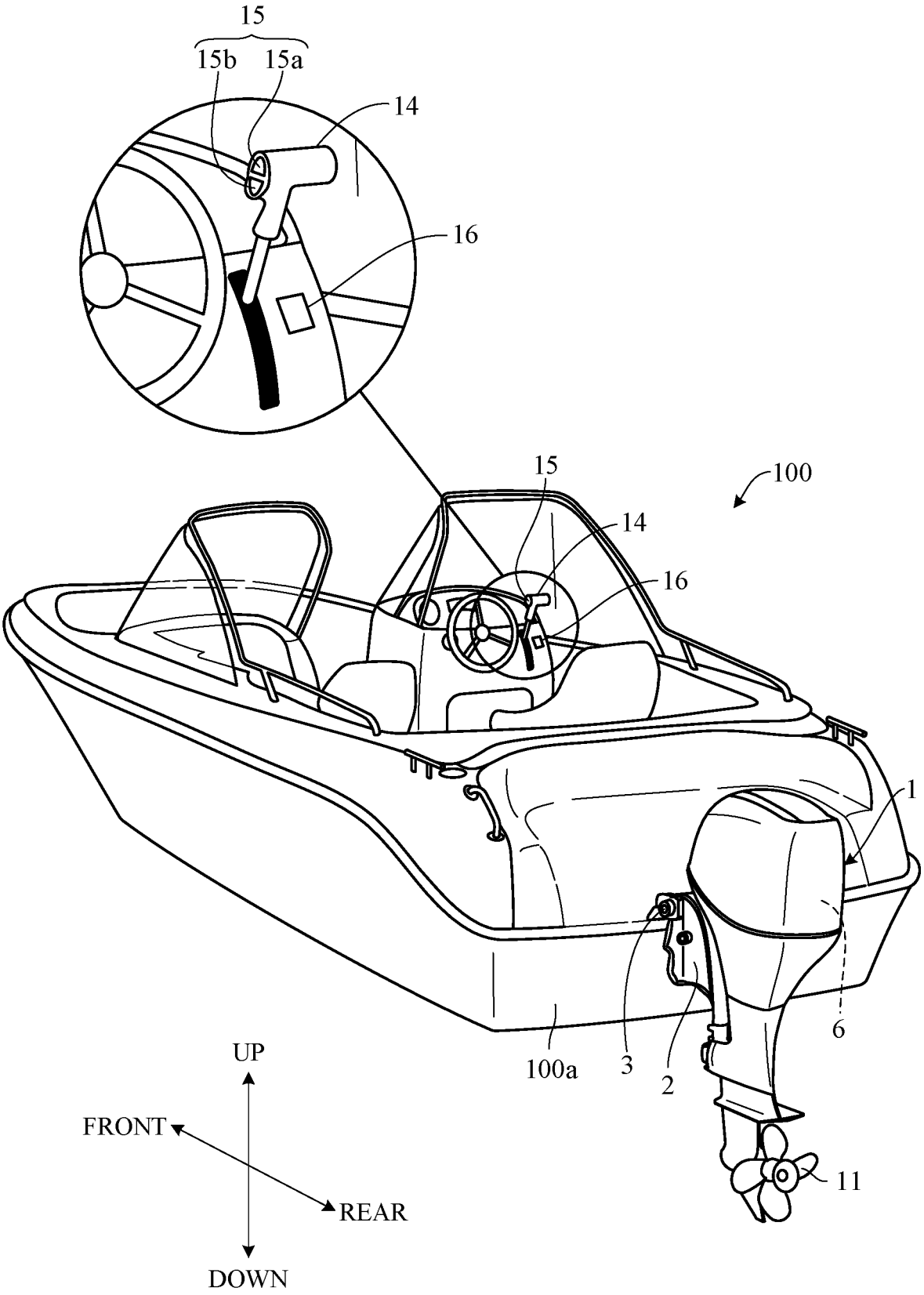
FIG. 1 is a perspective view schematically illustrating an example of the configuration of an outboard motor and a ship applied with a trim angle control apparatus according to an embodiment of the present invention.
Figure 2:
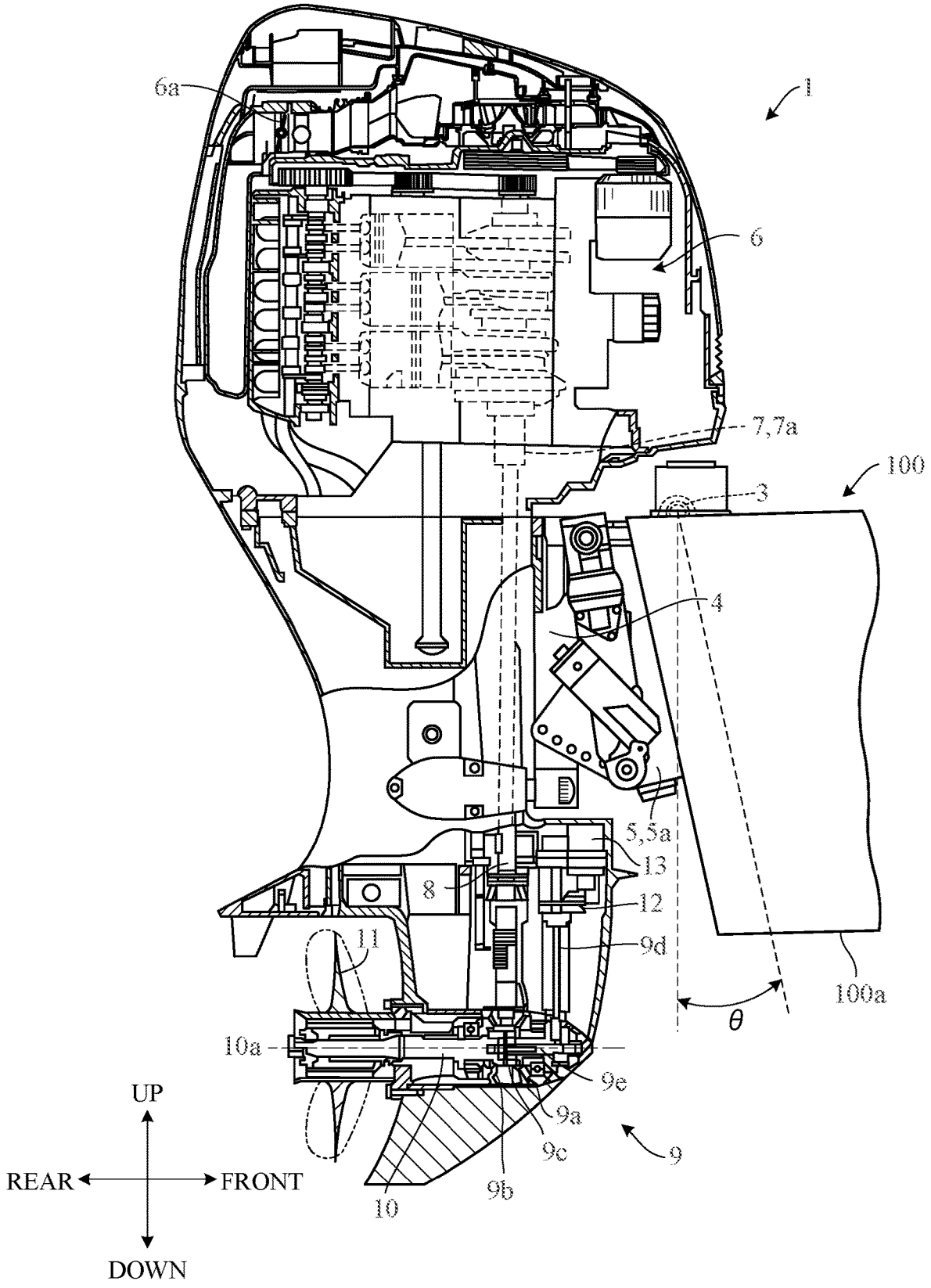
FIG. 2 is a side view of the outboard motor of FIG. 1.

Hereinafter, an embodiment of the present invention will be described with reference to FIGS. 1 to 6. FIG. 1 is a perspective view schematically illustrating an example of the configuration of an outboard motor 1 and a ship 100 applied with a trim angle control apparatus according to an embodiment of the present invention, and FIG. 2 is a side view of the outboard motor 1. Hereinafter, for convenience, the up-down direction, the left-right direction, and the front-rear direction are defined as illustrated in the drawing, and each unit will be described in accordance with this definition.

As illustrated in FIG. 1, the outboard motor 1 is attached to a transom board 100*a* at the rear of a hull (stem) of the ship 100 via a stern bracket 2 and a tilting shaft 3. As illustrated in FIG. 2, the outboard motor 1 is provided with a swivel case 4 in the vicinity of the stem bracket 2, and the vicinity of the swivel case 4 is provided with a trim angle adjustment mechanism 5 that adjusts a trim angle θ of the outboard motor 1 with respect to the ship 100 (the transom board 100*a*). The trim angle adjustment mechanism 5 includes an actuator 5*a* such as a hydraulic cylinder, and adjusts the trim angle θ by rotating the swivel case 4 with the tilting shaft 3 as a rotation axis.

An upper part of the outboard motor 1 is mounted with an engine 6 constituted by, for example, a spark-ignited water-cooled gasoline engine. The engine 6 is disposed such that the crankshaft 7 extends in the up-down direction, and the crankshaft 7 is provided with a crank angle sensor 7*a* that outputs a pulse signal with the rotation of the crankshaft 7. A rotational speed (engine speed) NE of the engine 6 can be calculated based on the pulse signal from the crank angle sensor 7*a*. The engine 6 includes an electric throttle valve 6*a* including, for example, a butterfly valve, and the engine speed NE is adjusted by adjusting the amount of intake air to the engine 6 by the throttle valve 6*a*.

The engine 6 (crankshaft 7) is connected to a propeller 11 that propels the ship 100 via a drive shaft 8 extending in the up-down direction, a shift mechanism 9, and a propeller shaft 10 extending in the front-rear direction. An axis 10*a* of the propeller shaft 10 is substantially parallel to the water surface when the trim angle adjustment mechanism 5 is in an initial state (trim angle θ=0°).

The shift mechanism 9 includes a forward bevel gear 9*a* and a reverse bevel gear 9*b* that engage with the drive shaft 8, a clutch 9*c* that connects and disconnects the forward bevel gear 9*a* or the reverse bevel gear 9*b* and the propeller shaft 10, a shift rod 9*d*, and a shift slider 9*e*. An upper end of the shift rod 9*d* is connected to an actuator 13 such as a motor via a reduction gear mechanism 12, and a lower end of the shift rod 9*d* is connected to the shift slider 9*e*.

The clutch 9*c* is driven by the actuator 13 via the shift rod 9*d* and the shift slider 9*e*, and switches the shift position of the shift mechanism 9 among the neutral position, the forward position, and the reverse position. When the shift position is switched to the forward position or the reverse position, the rotation of the engine 6 is transmitted to the propeller shaft 10 via the crankshaft 7, the drive shaft 8, and the shift mechanism 9, the propeller 11 rotates, and the ship 100 is propelled in the forward direction or the reverse direction.

As illustrated in FIG. 1, a vicinity of a cockpit of the outboard motor 1 is provided with a shift throttle lever 14 operated by the ship operator. The shift throttle lever 14 is configured to be swingable in the front-rear direction from the central neutral position. When the shift throttle lever 14 is switched from the neutral position to the forward position on the front side, the shift mechanism 9 (actuator 13) in FIG. 2 is switched from the neutral position to the forward position. When the shift throttle lever 14 is switched from the neutral position to the reverse position on the rear side, the shift mechanism 9 is switched from the neutral position to the reverse position. When the shift throttle lever 14 having been switched to the forward position or the reverse position is further tilted forward or reverse, the opening degree of the throttle valve 6*a* is adjusted in accordance with the displacement amount of the shift throttle lever 14, and the engine speed NE is adjusted.

The shift throttle lever 14 is provided with a trim angle adjustment unit 15 that is operated by the ship operator and inputs a change command of the trim angle θ. The trim angle adjustment unit 15 includes a trim up unit 15*a* that inputs a trim up command and a trim down unit 15*b* that inputs a trim down command. When the trim up command is input via the trim up unit 15*a*, the trim angle adjustment mechanism 5 (actuator 5*a*) is controlled such that the trim angle θ of the outboard motor 1 increases. When the trim down command is input via the trim down unit 15*b*, the trim angle adjustment mechanism is controlled such that the trim angle θ decreases.

The vicinity of the shift throttle lever 14 is provided with a switch 16 that is operated by the ship operator to switch on or off of a support trim mode for automatically adjusting the trim angle θ. When the support trim mode is off, the trim angle adjustment mechanism 5 adjusts the trim angle θ in accordance with the command from the trim angle adjustment unit 15. On the other hand, when the support trim mode is on, the trim angle adjustment mechanism 5 automatically adjusts the trim angle θ in accordance with a predetermined characteristic, and further adjusts the trim angle θ in accordance with the command from the trim angle adjustment unit 15 after the adjustment.

Figure 3:
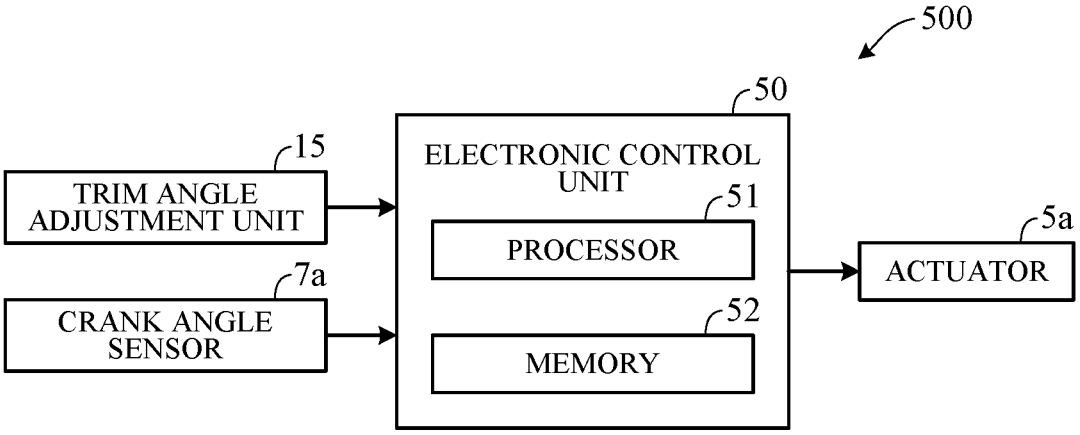
FIG. 3 is a block diagram schematically illustrating an example of the configuration of a main part of the trim angle control apparatus according to the embodiment of the present invention.

FIG. 3 is a block diagram schematically illustrating an example of the configuration of a main part of the trim angle control apparatus according to the embodiment of the present invention. A trim angle control apparatus 500 according to the embodiment of the present invention mainly includes an electronic control unit 50. The electronic control unit 50 is mounted on the ship 100 side in the vicinity of the cockpit of the outboard motor 1, for example. The electronic control unit 50 may be mounted on the outboard motor 1 side, or may include an electronic control unit mounted on the ship 100 side and an electronic control unit mounted on the outboard motor 1 side. As illustrated in FIG. 3, the electronic control unit 50 is configured to include a computer having a processor 51 such as a CPU, a memory 52 such as a ROM and a RAM, and other peripheral circuits. The electronic control unit 50 is connected with the trim angle adjustment unit 15, a sensor group including the crank angle sensor 7*a*, and an actuator group including the actuator 5*a* of the trim angle adjustment mechanism 5.

Figure 4:
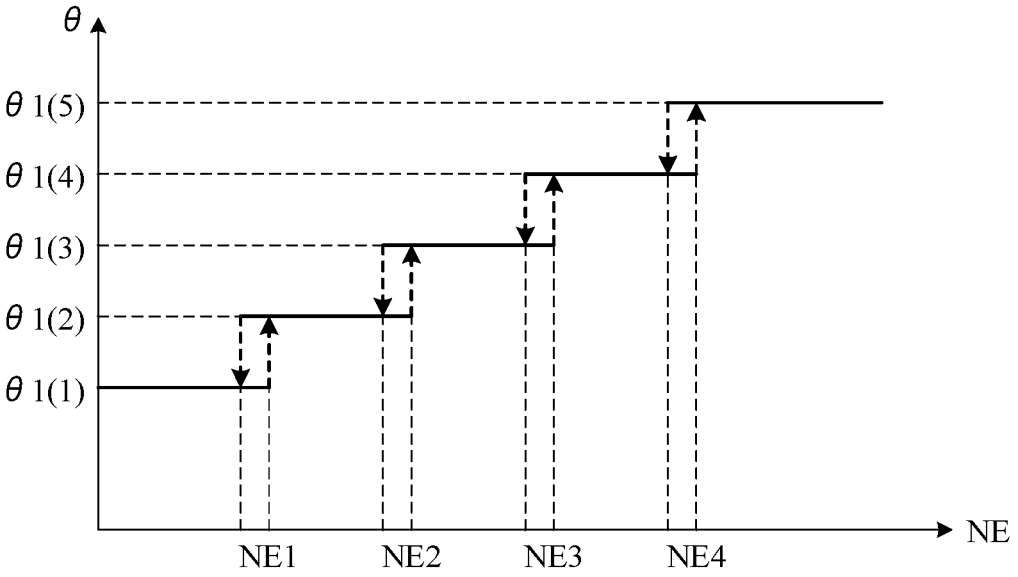
FIG. 4 is a view for describing a first target value of a trim angle set by the trim angle control apparatus according to the embodiment of the present invention.

FIG. 4 is a view for describing the target value of the trim angle θ set by the trim angle control apparatus 500, and illustrates an example of a first target value θ1 of the trim angle θ for each rotational speed range of the engine 6 stored in advance in the memory 52 of the electronic control unit 50. During the navigation of the ship 100, by adjusting the trim angle θ of the outboard motor 1, the direction of the propulsion force generated by the rotation of the propeller 11 under water, that is, the inclination angle of the axis 10*a* (FIG. 2) of the propeller shaft 10 with respect to the water surface is adjusted, thereby adjusting the propulsion force with respect to the ship 110.

The engine speed NE is adjusted via the shift throttle lever 14 (FIG. 1), and the trim angle θ is adjusted to an appropriate angle in accordance with the navigation situation of the ship 100 via the trim angle adjustment unit 15, thereby achieving smooth navigation of the ship 100. That is, the trim angle θ is adjusted appropriately in accordance with the navigation situation such as acceleration (NE1≤NE<NE2), planing (NE2≤NE<NE3), medium speed navigation (NE3 to NE4), and high-speed navigation (NE≥NE4), thereby achieving smooth navigation of the ship 100.

As illustrated in FIG. 4, the first target value θ1 of the trim angle θ is set in advance so as to become larger in a higher rotational speed for each rotational speed range of the engine 6. For example, θ1(1) is set in an idle rotational speed range (NE≤NE1), θ1(2) is set in an acceleration rotational speed range (NE1≤NE<NE2), and θ1(3) is set in a planing rotational speed range (NE2≤NE<NE3). θ1(4) is set in a medium speed rotational speed range (NE3≤NE<NE4), and θ1(5) is set in a high-speed rotational speed range (NE≥NE4).

As illustrated in FIG. 4, the first target value θ1 of the trim angle θ is set to have hysteresis characteristics of, for example, about 200 rpm with respect to the engine speed NE. Therefore, it is possible to prevent hunting of the trim angle θ in a boundary region of the rotational speed range. The setting of the first target value θ1, the rotational speed range, and the hysteresis characteristics can be changed by using a service tool, for example, at a dealer of the outboard motor 1 or the like in accordance with the specifications of the outboard motor 1 and the ship 100, a desire of a user (ship operator), and the like.

When the support trim mode is switched to on via the switch 16 (FIG. 1), the processor 51 of the electronic control unit 50 adjusts the trim angle θ so as to become the first target value θ1 in accordance with the engine speed NE based on the signal from the crank angle sensor 7*a*. More specifically, when the rotational speed range of the engine 6 changes or the trim angle adjustment unit 15 is operated after the support trim mode is switched to on, the support trim mode is started. In the support trim mode, with reference to the characteristics (FIG. 4) stored in the memory 52, the trim angle adjustment mechanism 5 (actuator 5*a*) is controlled such that the trim angle θ becomes the first target value θ1(*n*) in the rotational speed range corresponding to the current engine speed NE.

Furthermore, when the trim up command or the trim down command is input via the trim angle adjustment unit 15, the processor 51 determines a change amount Δθ of the trim angle θ in accordance with the operation amount (e.g., operation time) of the trim angle adjustment unit 15. More specifically, when the trim up command is input via the trim up unit 15*a*, a positive change amount Δθ is determined, and when the trim down command is input via the trim down unit 15*b*, a negative change amount Δθ is determined. The processor 51 calculates a second target value θ2 (θ2=θ1+Δθ) by adding the determined change amount Δθ to the first target value θ1, and further controls the trim angle adjustment mechanism 5 so that the trim angle θ becomes the second target value θ2.

By using the support trim mode, the ship operator of the ship 100 can perform smooth ship steering by operation of only the shift throttle lever 14 without adjusting the trim angle adjustment unit 15 by himself (trim angle θ=first target value θ1). Even during the use of the support trim mode, the trim angle θ can be further adjusted via the trim angle adjustment unit 15 in accordance with the navigation situation at that time such as the boarding state of the ship 100 and weather conditions (trim angle θ=second target value θ2).

When the change amount Δθ of the trim angle θ or the second target value θ2 adjusted in accordance with the navigation situation at that time is reset by the ship operator every time the rotational speed range changes, it becomes troublesome for the ship operator. Therefore, in the present embodiment, the trim angle control apparatus 500 is configured as follows so that the operation burden on the ship operator can be reduced by holding the value of the second target value θ2 of the trim angle θ changed in accordance with the operation by the ship operator.

Figure 5A:
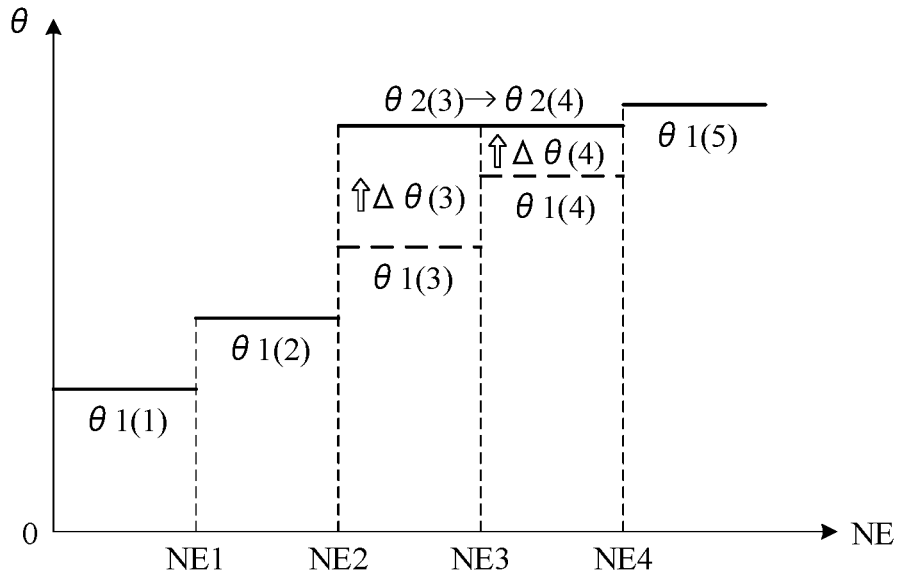
FIG. 5A is a view for describing a change of the target value of the trim angle by the trim angle control apparatus according to the embodiment of the present invention, where a trim up command is input.
Figure 5B:
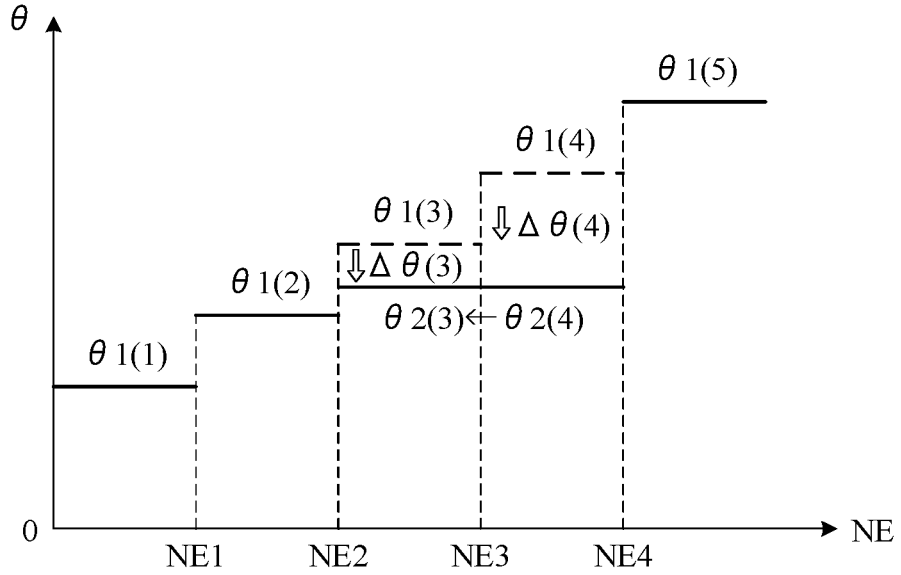
FIG. 5B is a view for describing a change of the target value of the trim angle by the trim angle control apparatus according to the embodiment of the present invention, where a trim down command is input.

FIGS. 5A and 5B are views for describing the change of the target value of the trim angle θ by the trim angle control apparatus 500, where FIG. 5A illustrates a case where the trim up command is input, and FIG. 5B illustrates a case where the trim down command is input. When the trim up or trim down command is input via the trim angle adjustment unit 15 after adjusting the trim angle θ to the first target value θ1 in the support trim mode, the processor 51 determines the change amount Δθ of the trim angle θ and calculates the second target value θ2 of the trim angle θ.

Furthermore, the processor 51 changes the target value of the trim angle θ from the first target value θ1 to the second target value θ2 and updates the RAM value of the memory 52. The second target value θ2 stored in the memory 52 as the RAM value is held for a period until the support trim mode is off, a period until the engine 6 is stopped, or a period until the electronic control unit 50 (FIG. 3) is off. The second target value θ2 stored in the memory 52 as the RAM value is erased when the support trim mode is off, the engine 6 is stopped, or the electronic control unit 50 is off. In this case, the target value of the trim angle θ stored in the memory 52 is reset to the first target value θ1.

As illustrated in FIG. 5A, when the trim up command is input, the processor 51 calculates the second target value θ2(*n*) in the current rotational speed range, and determines whether or not the calculated second target value θ2(*n*) exceeds the first target value θ1(*n*+1) in the rotational speed range on the high rotation side. For example, when the trim up command is input in the planing rotational speed range, it is determined whether or not the second target value θ2(3) in the planing rotational speed range exceeds the first target value θ1(4) in the medium speed rotational speed range.

When it is determined that the second target value θ2(*n*) in the current rotational speed range exceeds the first target value θ1(*n*+1) in the rotational speed range on the high rotation side, the second target value θ2(*n*+1) in the rotational speed range on the high rotation side is set such that the second target value θ2(*n*) in the current rotational speed range is maintained when the engine speed NE increases. In the example of FIG. 5A, the second target value θ2(4) in the medium speed rotational speed range is set to the same value as the second target value θ2(3) in the planing rotational speed range so that the second target value θ2(3) in the planing rotational speed range is maintained.

On the other hand, as illustrated in FIG. 5B, when the trim down command is input, the processor 51 calculates the second target value θ2(*n*) in the current rotational speed range, and determines whether or not the calculated second target value θ2(*n*) falls below the first target value θ1(*n*−1) in the rotational speed range on the low rotation side. For example, when the trim down command is input in the medium speed rotational speed range, it is determined whether or not the second target value θ2(4) in the medium speed rotational speed range falls below the first target value θ1(3) in the planing rotational speed range.

When it is determined that the second target value θ2(*n*) in the current rotational speed range falls below the first target value θ1(*n*−1) in the rotational speed range on the low rotation side, the second target value θ2(*n*−1) in the rotational speed range on the low rotation side is set such that the second target value θ2(*n*) in the current rotational speed range is maintained when the engine speed NE decreases. In the example of FIG. 5B, the second target value θ2(3) in the planing rotational speed range is set to the same value as the second target value θ2(4) in the medium speed rotational speed range so that the second target value θ2(4) in the medium speed rotational speed range is maintained.

The intention of the ship operator to change the trim angle θ for each rotational speed range is reflected in a necessary and sufficient range in this manner, whereby it is possible to prevent the ship operator from feeling uncomfortable due to the trim down when the engine speed NE is increasing or the trim up when the engine speed NE is decreasing.

Figure 6:
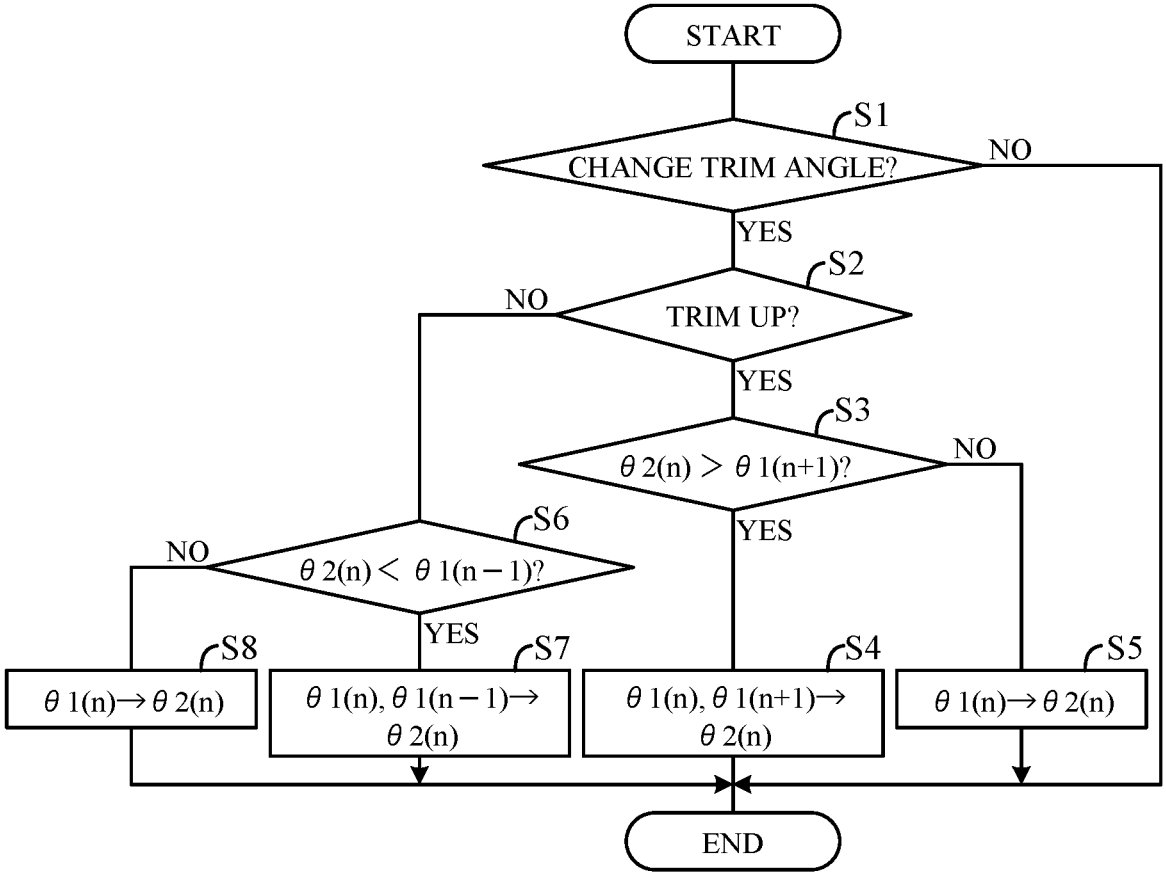
FIG. 6 is a flowchart illustrating an example of processing executed by the trim angle control apparatus according to the embodiment of the present invention.

FIG. 6 is a flowchart illustrating an example of processing executed by the trim angle control apparatus 500 according to the embodiment of the present invention. The processing of FIG. 6 starts when the support trim mode is switched to on, and is repeated at a predetermined cycle until the support trim mode is switched to off. Switching of the support trim mode from off to on is performed in response to an operation of the switch 16 (FIG. 1) by the ship operator. Switching of the support trim mode from on to off is performed in response to an operation of the switch 16 by the ship operator, and is also performed in conjunction with, for example, stop of the engine 6 and off of the electronic control unit 50 (FIG. 3).

As illustrated in FIG. 6, first, in step 51, it is determined whether or not a change command of the trim angle θ has been input. If the determination is positive in step 51, the process proceeds to step S2, and if the determination is negative, the process ends. In step S2, it is determined whether or not the change command input in step 51 is a trim up command. When the trim up command is input, the determination is positive in step S2, and the process proceeds to step S3. When the trim down command is input, the determination is negative in step S2, and the process proceeds to step S6.

In step S3, the second target value θ2(*n*) of the trim angle θ in the rotational speed range corresponding to the current engine speed NE is calculated, and it is determined whether or not it exceeds the first target value θ1(*n*+1) in the rotational speed range on the high rotation side. If the determination is positive in step S3, the process proceeds to step S4, and the first target value θ1(*n*) in the current rotational speed range and the first target value θ1(*n*+1) in the rotational speed range on the high rotation side are changed to the second target value θ2(*n*) in the current rotational speed range calculated in step S3. On the other hand, if the determination is negative in step S3, the process proceeds to step S5, and only the first target value θ1(*n*) in the current rotational speed range is changed to the second target value θ2(*n*) in the current rotational speed range calculated in step S3.

In step S6, the second target value θ2(*n*) of the trim angle θ in the rotational speed range corresponding to the current engine speed NE is calculated, and it is determined whether or not it falls below the first target value θ1(*n*−1) in the rotational speed range on the low rotation side. If the determination is positive in step S6, the process proceeds to step S7, and the first target value θ1(*n*) in the current rotational speed range and the first target value θ1(*n*−1) in the rotational speed range on the low rotation side are changed to the second target value θ2(*n*) in the current rotational speed range calculated in step S6. On the other hand, when the determination is negative in step S6, the process proceeds to step S8, and only the first target value θ1(*n*) in the current rotational speed range is changed to the second target value θ2(*n*) in the current rotational speed range calculated in step S3.

As described above, when the trim up command and the trim down command are input in the support trim mode (step S1), the first target value θ1 of the trim angle θ in accordance with the engine speed NE is changed to the second target value θ2 reflecting the intention of the ship operator (steps S4, S5, S7, and S8). Due to this, for example, the trim angle θ can be automatically adjusted with the intention of the ship operator who changes the trim angle in accordance with the navigation situation on the day being reflected. Since the second target value θ2 of the trim angle θ is held until the support trim mode is switched to off or the engine 6 is stopped, the operation burden on the ship operator can be reduced.

According to the present embodiment, the following functions and effects can be achieved.

(1) The trim angle control apparatus 500 controls the trim angle θ of the outboard motor 1 including the engine 6 (FIGS. 1 to 3). The trim angle control apparatus 500 includes the crank angle sensor 7*a* that detects the engine speed NE of the engine 6, the actuator 5*a* that adjusts the trim angle θ of the outboard motor 1, the trim angle adjustment unit 15 that is operated by the ship operator and to input a change command for changing the trim angle θ, and the electronic control unit 50 having the processor 51 and the memory 52 connected to the processor 51 (FIG. 3).

In the memory 52, the target value of the trim angle θ is stored in advance for each rotational speed range of the engine 6. The processor 51 is configured so as to set the target value of the trim angle θ in accordance with the engine speed NE detected by the crank angle sensor 7*a*, and control the actuator 5*a* so that the trim angle θ becomes the target value. Setting the target value includes changing the target value in accordance with the change command when the change command is input via the trim angle adjustment unit 15.

Due to this, for example, the trim angle θ can be automatically adjusted with the intention of the ship operator who changes the trim angle in accordance with the navigation situation on the day being reflected. Since the target value (RAM value) itself of the trim angle θ stored in the memory 52 is changed, for example, the changed target value is held during the support trim mode or during the operation of the engine 6, whereby the operation burden on the ship operator can be reduced.

(2) The processor 51 rewrites and stores, into the memory 52, the rotational speed range and the target value in accordance with the command from an external device such as a service tool. This enables the first target value θ1 of an appropriate trim angle θ to be set in accordance with, for example, the specifications of the outboard motor 1 and the ship 100, a desire of the ship operator, who is the user of the outboard motor 1, and the like.

(3) Setting the target value includes setting the first target value θ1 of the trim angle θ in accordance with the engine speed NE detected by the crank angle sensor 7*a*, and then, when the change command is input, setting the change amount Δθ of the trim angle θ in accordance with the change command, and setting the second target value θ2 of the trim angle θ by adding the change amount Δθ to the first target value θ1. The first target value θ1 is set to be larger in a higher rotational speed (FIG. 4). The rotational speed range includes the planing rotational speed range (NE2≤NE<NE3) and the medium speed rotational speed range (NE3≤NE<NE4), which is higher in rotation than the planing rotational speed range. The change command includes the trim up command for increasing the trim angle θ and the trim down command for decreasing the trim angle θ.

Changing the target value includes determining whether or not the second target value θ2(3) in the planing rotational speed range exceeds the first target value θ1(4) in the medium speed rotational speed range when the trim up command is input in the planing rotational speed range, and, when it is determined to exceed, setting the second target value θ2(4) in the medium speed rotational speed range so that the second target value θ2(3) in the planing rotational speed range is maintained when the engine speed NE is increasing (FIG. 5A). This can prevent the ship operator from feeling uncomfortable due to automatic trim down when the engine speed NE is increasing.

(4) Changing the target value includes determining whether or not the second target value θ2(4) in the medium speed rotational speed range falls below the first target value θ1(3) in the planing rotational speed range when the trim down command is input in the medium speed rotational speed range, and, when it is determined to fall below, setting the second target value θ2(3) in the planing rotational speed range so that the second target value θ2(4) in the medium speed rotational speed range is maintained when the engine speed NE is decreasing (FIG. 5B). This can prevent the ship operator from feeling uncomfortable due to automatic trim up when the engine speed NE is decreasing.

(5) The trim angle control apparatus 500 further includes the switch 16 that switches on or off of the support trim mode that permits the setting of the target value of the trim angle θ by the processor 51 (FIG. 1). This enables on and off of the support trim mode to be switched as necessary, it is possible to prevent the trim angle θ from being automatically adjusted against the intention of the ship operator.

(6) When the support trim mode is switched to off by the switch 16, the second target value θ2 of the trim angle θ set in the period in which the support trim mode is on is reset. Due to this, for example, by switching on and off of the support trim mode, it is possible to reset as necessary the second target value θ2 of the trim angle θ reflecting the temporary intention of the ship operator, and to use the first target value θ1 set in accordance with the specifications of the outboard motor 1 and the ship 100.

(7) When the engine 6 is stopped, the second target value θ2 of the trim angle θ set during the operation of the engine 6 is reset. Due to this, the second target value θ2 of the trim angle θ only for that day reflecting the temporary intention of the ship operator is reset every time the engine 6 is stopped, and the first target value θ1 set in accordance with the specifications of the outboard motor 1 and the ship 100 can be used at the next start up time.

(8) The target value has hysteresis characteristics with respect to the engine speed NE (FIG. 4). This can prevent hunting of the trim angle θ from occurring in the boundary region of the rotational speed range.

In the above embodiment, the specific outboard motor 1, the engine 6, and the ship 100 are exemplified and described in FIGS. 1 and 2, but the outboard motor, a prime mover, and the ship are not limited to these. For example, the prime mover is not limited to an engine such as an internal combustion engine, and may be a motor or the like. FIG. 1 and the like exemplify the trim angle adjustment unit 15 having the trim up unit 15*a* and the trim down unit 15*b* and the switch 16 in the support trim mode, but the operation member and the switch are not limited to these.

Although the present invention has been described above as the trim angle control apparatus 500, the present invention can also be used as a trim angle control method for controlling the trim angle of an outboard motor having a prime mover. That is, the trim angle control method includes storing a target value of the trim angle θ in advance for each rotational speed range of the engine 6, setting the target value of the trim angle θ in accordance with the engine speed NE of the engine 6 detected by the crank angle sensor 7*a*, and controlling the actuator 5*a* that adjusts the trim angle θ of the outboard motor 1 so that the trim angle θ becomes the target value. Setting the target value includes changing the target value in accordance with a change command (steps S2 to S8) when the change command for changing the trim angle θ is input via the trim angle adjustment unit 15 operated by the ship operator (step S1 in FIG. 6).

The above description is only an example, and the present invention is not limited to the above embodiment and modifications, unless impairing features of the present invention. The above embodiment can be combined as desired with one or more of the above modifications. The modifications can also be combined with one another.

REFERENCE SIGNS LIST

1 outboard motor, 5 trim angle adjustment mechanism, 5*a* actuator, 6 engine, 7*a* crank angle sensor, 14 shift throttle lever, 15 trim angle adjustment unit, 15*a* trim up unit, 15*b* trim down unit, 16 switch, 50 electronic control unit, 51 processor, 52 memory, 100 ship, 500 trim angle control apparatus.

The invention claimed is:

1. A trim angle control apparatus configured to control a trim angle of an outboard motor including a prime mover, comprising:

a detector configured to detect a rotational speed of the prime mover;

an actuator configured to adjust the trim angle of the outboard motor;

an operation member configured to be operated by a ship operator to input a change command for changing the trim angle; and an electronic control unit including a processor and a memory coupled to the processor, wherein the memory stores a target value of the trim angle for each rotational speed range of the prime mover, wherein the processor is configured to perform:

controlling the actuator so that the trim angle becomes the target value, wherein the target value includes:

a first target value for each rotational speed range set in advance to be larger in a higher rotational speed range; and a second target value for each rotational speed range set in accordance with operation by the ship operator, wherein the change command includes:

a trim up command for increasing the trim angle; and a trim down command for decreasing the trim angle, wherein the processor:

sets the first target value corresponding to a current rotational speed range including the rotational speed detected by the detector;

sets a change amount of the trim angle in accordance with the change command when the change command is input through the operation member;

sets the second target value corresponding to the current rotational speed range by adding the change amount to the first target value corresponding to the current rotational speed range;

determines whether the second target value corresponding to the current rotational speed range exceeds the first target value corresponding to a rotational speed range immediately higher than the current rotational speed range when the trim up command is input;

sets the second target value corresponding to the rotational speed range immediately higher than the current rotational speed range to the same value as the second target value corresponding to the current rotational speed range when it is determined that the second target value corresponding to the current rotational speed range exceeds the first target value corresponding to the rotational speed range immediately higher than the current rotational speed range; and controls the actuator so that the trim angle becomes the second target value.

2. The trim angle control apparatus according to claim 1, wherein the processor rewrites and stores the rotational speed range and the target value into the memory in accordance with a command from an external device.

3. The trim angle control apparatus according to claim 1, wherein the processor:

determines whether the second target value corresponding to the current rotational speed range falls below the first target value corresponding to a rotational speed range immediately lower than the current rotational speed range when the trim down command is input; and sets the second target value corresponding to the rotational speed range immediately lower than the current rotational speed range to the same value as the second target value corresponding to the current rotational speed range when it is determined that the second target value corresponding to the current rotational speed range falls below the first target value corresponding to the rotational speed range immediately lower than the current rotational speed range.

4. The trim angle control apparatus according to claim 1, further comprising:

a switch configured to switch between: a permit mode for permitting setting of the second target value by the processor; and a prohibit mode for prohibiting the setting of the second target value by the processor.

5. The trim angle control apparatus according to claim 4, wherein the second target value set in the permit mode is reset when the permit mode is switched to the prohibit mode by the switch.

6. The trim angle control apparatus according to claim 1, wherein the second target value set during operation of the prime mover is reset when the prime mover is stopped.

7. The trim angle control apparatus according to claim 1, wherein the target value has hysteresis characteristics with respect to the rotational speed.

8. A trim angle control method configured to control a trim angle of an outboard motor including a prime mover, comprising:

storing a target value of the trim angle for each rotational speed range of the prime mover; and controlling an actuator configured to adjust the trim angle of the outboard motor so that the trim angle becomes the target value, wherein the target value includes:

a first target value for each rotational speed range set in advance to be larger in a higher rotational speed range; and a second target value for each rotational speed range set in accordance with operation by a ship operator, wherein the change command includes:

a trim up command for increasing the trim angle; and a trim down command for decreasing the trim angle, wherein the trim angle control method further comprises:

setting the first target value corresponding to a current rotational speed range including a rotational speed of the prime mover detected by a detector;

setting a change amount of the trim angle in accordance with a change command for changing the trim angle when the change command is input through an operation member configured to be operated by the ship operator;

setting the second target value corresponding to the current rotational speed range by adding the change amount to the first target value corresponding to the current rotational speed range;

determining whether the second target value corresponding to the current rotational speed range exceeds a first target value corresponding to a rotational speed range immediately higher than the current rotational speed range when the trim up command is input;

setting the second target value corresponding to the rotational speed range immediately higher than the current rotational speed range to the same value as the second target value corresponding to the current rotational speed range when it is determined that the second target value corresponding to the current rotational speed range exceeds the first target value corresponding to the rotational speed range immediately higher than the current rotational speed range; and controlling the actuator so that the trim angle becomes the second target value.

* * * * *